US011578514B2

(12) United States Patent
Han et al.

(10) Patent No.: US 11,578,514 B2
(45) Date of Patent: Feb. 14, 2023

(54) RETRACTABLE OUTSIDE DOOR HANDLE ASSEMBLY

(71) Applicants: Hyundai Motor Company, Seoul (KR); Kia Motors Corporation, Seoul (KR)

(72) Inventors: Jungho Han, Seoul (KR); Jinwoo Nam, Seoul (KR); Kyoung Taek Kwak, Yongin-Si (KR); Dong Jun Kim, Bucheon-Si (KR); Do Won Sung, Suwon-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 61 days.

(21) Appl. No.: 17/184,383

(22) Filed: Feb. 24, 2021

(65) Prior Publication Data

US 2022/0074244 A1 Mar. 10, 2022

(30) Foreign Application Priority Data

Sep. 4, 2020 (KR) ..... 10-2020-0113341

(51) Int. Cl.
*E05B 79/06* (2014.01)
*E05B 85/10* (2014.01)
*E05B 85/16* (2014.01)

(52) U.S. Cl.
CPC ..... *E05B 85/107* (2013.01); *E05B 79/06* (2013.01); *E05B 85/16* (2013.01); *E05Y 2201/68* (2013.01); *E05Y 2201/686* (2013.01); *E05Y 2201/704* (2013.01)

(58) Field of Classification Search
CPC ..... E05B 85/107; E05B 79/06; E05B 85/16; E05B 79/10; E05B 85/103; E05Y 2201/68; E05Y 2201/686; E05Y 2201/704; E05Y 2800/422
See application file for complete search history.

(56) References Cited

U.S. PATENT DOCUMENTS

| | | | | |
|---|---|---|---|---|
| 10,533,353 | B2 * | 1/2020 | Smart | E05B 81/76 |
| 10,759,290 | B2 * | 9/2020 | Sha | E05C 19/16 |
| 11,332,963 | B2 * | 5/2022 | Karlein | E05B 81/28 |
| 2013/0062892 | A1 * | 3/2013 | Chow | E05C 1/16 292/175 |
| 2016/0288366 | A1 * | 10/2016 | Tajima | C04B 35/62625 |
| 2018/0274271 | A1 * | 9/2018 | Och | E05B 77/06 |

* cited by examiner

*Primary Examiner* — Kristina R Fulton
*Assistant Examiner* — Thomas L Neubauer
(74) *Attorney, Agent, or Firm* — Morgan, Lewis & Bockius LLP

(57) ABSTRACT

A retractable outside door handle assembly may include a handle unit including a pushing portion and an outside door handle mounted selectively protruded outwardly to a handle housing, an actuator including a drive motor, a worm connected to the drive motor, a worm wheel engaging with the worm, and an operation rod that moves according to rotation of the worm wheel to push the pushing portion, and a door latch lever that is rotatably mounted on the handle housing and rotates during operation of the outside door handle protruded by operation of the actuator.

13 Claims, 17 Drawing Sheets

RETRACTABLE OUTSIDE DOOR HANDLE ASSEMBLY

CROSS-REFERENCE TO RELATED APPLICATION

The present invention claims priority to Korean Patent Application No. 10-2020-0113341 filed on Sep. 4, 2020, the entire contents of which is incorporated herein for all purposes by this reference.

BACKGROUND OF THE PRESENT INVENTION

Field of the Present Invention

The present invention relates to a retractable outside door handle assembly. More particularly, the present invention relates to a retractable outside door handle assembly that is easy to tune in power and operation speed with a simple structure.

Description of Related Art

In general, a vehicle has a predetermined size of cabin formed therein for boarding of a driver and accompanying occupants, and cabin opening/closing doors are provided for opening/closing the cabin.

For easily opening and closing the cabin opening/closing door by the passenger, an inside door handle is mounted on an inside face toward a cabin inside of the door, and an outside door handle is mounted on an outside face toward a cabin outside of the door.

Each door handle is connected to be interworked with a door ratchet to fix the door to a vehicle body, such that the door may be opened while the door ratchet is released according to an operation of each door handle.

The outside door handle is generally mounted to be pivotally movable to the outer panel of the door, and in this case, the outside door handle is installed on the door outer panel to be protruded outside along a width direction of the vehicle so that the passenger may easily hold the outside door handle.

As above-described, if the outside door handle is installed to be protruded outside along a width direction of the vehicle, operation convenience of the passenger is improved, however exterior beauty of the vehicle may be deteriorated due to the protruded outside door handle, also, a running noise may not be only caused in traveling of the vehicle, but also running performance may be also deteriorated due to running resistance.

Recently, to solve these problems, a retractable outside door handle, in which the outside door handle is protruded outside along the width direction of the vehicle from the door outer panel or is received inside a receiving hole formed in the door outer panel by the driving of an actuator (a motor) not to be protruded from the door outer panel outside, has been developed.

The conventional retractable outside door handle assembly may have the outside door handle protrude from the door outer panel via a link mechanism or may receive it inside the receiving hole of the door outer panel through the actuator, and is connected to a door lock mechanism including a key cylinder capable of being operated for locking or releasing the door to the vehicle body and a door ratchet mechanism directly locking or releasing the door to/from the vehicle body.

However, in the structure of a general retractable outside door handle assembly, three or more stages of reduction gear are applied due to the structure characteristic, and the rotation speed of the intermediate gears is fast, so vibration and noise are often generated during operation.

In addition, it is difficult to change the operation power/operation speed at the time of initial design because it affects other gear combinations when adjusting the operating force and operating speed according to the gear combination method.

The information disclosed in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a retractable outside door handle assembly that is easy to tune in power and operation speed with a simple structure.

A retractable outside door handle assembly according to various exemplary embodiments of the present invention may include a handle unit including a pushing portion and an outside door handle mounted selectively protruded outwardly to a handle housing, an actuator including a drive motor, a worm connected to the drive motor, a worm wheel engaging with the worm, and an operation rod that moves according to rotation of the worm wheel to push the pushing portion, and a door latch lever that is rotatably mounted on the handle housing and rotates during operation of the outside door handle protruded by operation of the actuator.

An inner thread may be formed on the inside of the worm wheel, and an operation rod thread that engages with the inner thread may be formed on an outside of the operation rod.

A guide portion that prevents rotation of the operation rod may be formed on the operation rod.

The actuator may further include a position sensor for detecting movement of the operation rod.

The handle unit may further include a handle rotation pin rotatably connecting the outside door handle to the handle housing.

The retractable outside door handle assembly according to various exemplary embodiments of the present invention may further include an extension rod provided between the operation rod and the pushing portion.

A predetermined gap may be formed between the pushing portion and the extension rod.

The retractable outside door handle assembly according to various exemplary embodiments of the present invention may further include a handle leg formed on the outside door handle to enable contact with the door latch lever when protruding by the operation of the actuator.

The retractable outside door handle assembly according to various exemplary embodiments of the present invention may further include a handle spring that provides a reaction torque to the outside door handle.

The handle unit may include a connection link of which the pushing portion is formed at one end thereof, and the connection link mounted on the handle housing to be movable along longitudinal direction thereof according to the operation of the actuator, a front link rotatably connected to the connection link and the outside door handle, a rear link rotatably connected to the connecting link and the outside door handle, and a support link rotatably connected to the rear link and the handle housing.

The retractable outside door handle assembly according to various exemplary embodiments of the present invention may further include a support link torque spring that imparts rotation torque to the support link.

The connection link and the front link, and the connection link and the rear link may be connected through a guide pin respectively.

The handle housing may be formed with a guide slot into which the guide pin is inserted to guide the movement of the connection link.

The door latch lever may have a lever hole into which the guide pin is inserted.

According to the retractable outside door handle assembly according to various exemplary embodiments of the present invention, power and operation speed tuning may be easy with a simple structure.

According to the retractable outside door handle assembly according to various exemplary embodiments of the present invention, it is possible to suppress the occurrence of vibration and noise during actuator operation.

In addition, effects that can be obtained or predicted by the embodiments of the present invention will be disclosed directly or implicitly in the detailed description of the present invention. That is, various effects predicted according to various exemplary embodiments of the present invention will be disclosed within a detailed description to be described later.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
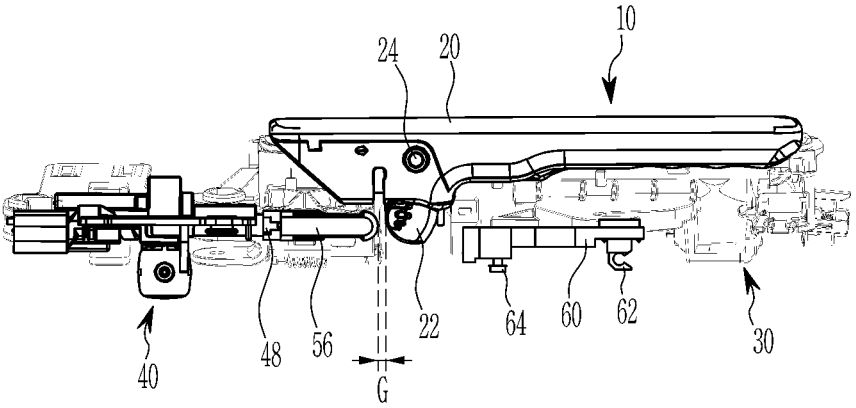
FIG. 1 is a front view of a retractable outside door handle assembly according to various exemplary embodiments of the present invention.

It may be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments, it will be understood that the present description is not intended to limit the present invention(s) to those exemplary embodiments. On the contrary, the present invention(s) is/are intended to cover not only the exemplary embodiments, but also various alternatives, modifications, equivalents and other embodiments, which may be included within the spirit and scope of the present invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Parts indicated by the same reference numerals throughout the specification mean the same components.

In the drawings, the thickness of layers, films, panels, regions, etc., are exaggerated for clarity.

When a part such as a layer, film, region, or plate is said to be "on" another part, this includes not only the case directly above the other part, but also the case where there is another part in between.

In contrast, when an element is referred to as being "directly on" another element, there are no intervening elements present.

Throughout the specification, when a part "includes" a certain component, it means that other components may be further included rather than excluding other components unless specifically stated to the contrary.

An exemplary embodiment of the present invention will hereinafter be described in detail with reference to the accompanying drawings.

Figure 2:
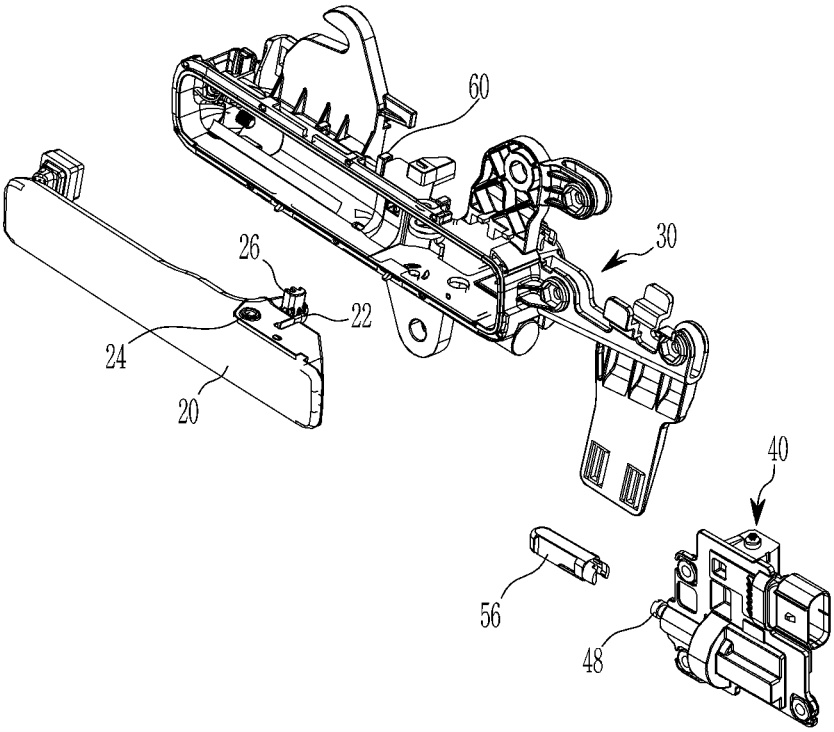
FIG. 2 is an exploded perspective view of a retractable outside door handle assembly according to various exemplary embodiments of the present invention.

FIG. 1 is a front view of a retractable outside door handle assembly according to various exemplary embodiments of the present invention, and FIG. 2 is an exploded perspective view of a retractable outside door handle assembly according to various exemplary embodiments of the present invention.

Referring to FIG. 1 and FIG. 2, a retractable outside door handle assembly according to various exemplary embodiments of the present invention may include a handle unit 10 including a pushing portion 22 and an outside door handle 20 mounted selectively protruded outwardly to a handle housing 30, an actuator 40, and a door latch lever 60 that is rotatably mounted on the handle housing 30 and rotates during the operation of the outside door handle 20 protruded by the operation of the actuator 40.

The handle unit 10 may further include a handle rotation pin 24 for rotatably mounting the outside door handle 20 to the handle housing 30.

The door latch lever 60 is rotatably mounted to the handle housing 30 by a door latch lever pin 64, and a lever hook 62 may be connected to the door latch lever 60. The lever hook 62 is connected to by a cable or a rod, and when an occupant or the like operates the outside door handle 20, the door latch lever 60 rotates to release the connection between the door and the door latch. Since the structure of the connection between the door and the door latch and the cable or rod is obvious to a person skilled in the art, a detailed description will be omitted.

Figure 3:
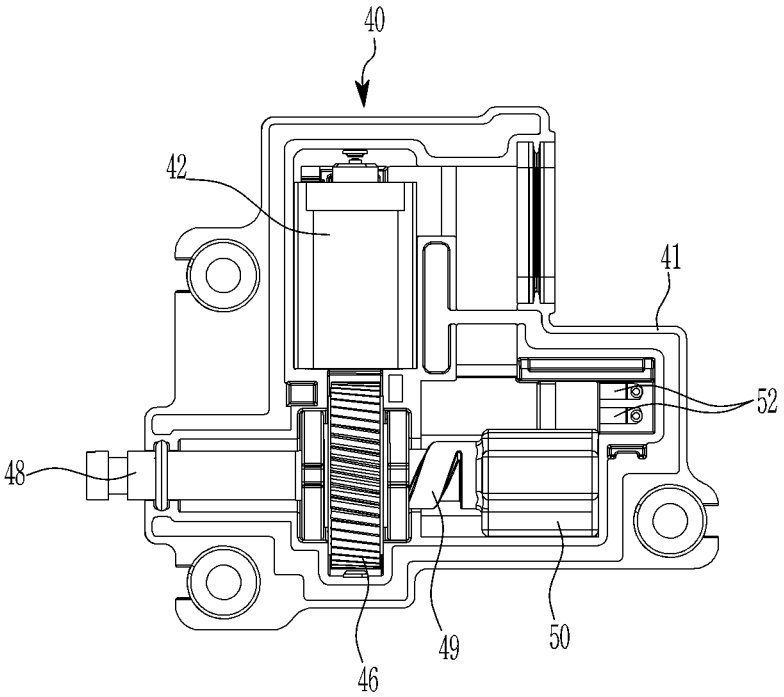
FIG. 3 is a cross-sectional view of an actuator that can be applied to a retractable outside door handle assembly according to various exemplary embodiments of the present invention.
Figure 4:
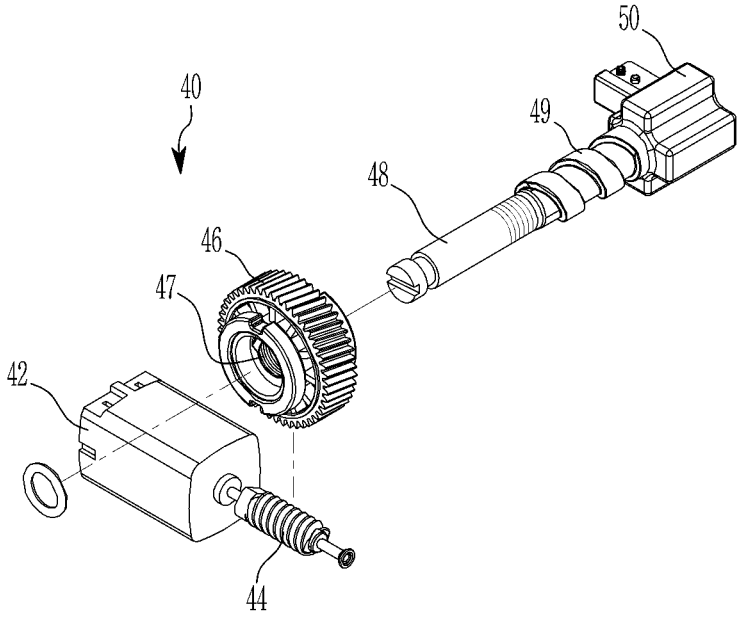
FIG. 4 is an exploded perspective view of the actuator that can be applied to the retractable outside door handle assembly according to various exemplary embodiments of the present invention.

FIG. 3 is a cross-sectional view of an actuator that can be applied to a retractable outside door handle assembly according to various exemplary embodiments of the present invention, and FIG. 4 is an exploded perspective view of the actuator that can be applied to the retractable outside door handle assembly according to various exemplary embodiments of the present invention.

Referring to FIG. 3 and FIG. 4, the actuator 40 includes a drive motor 42, a worm 44 connected to the drive motor 42, a worm wheel 46 engaged with the worm 44, and an operation rod 48 moving according to rotation of the worm wheel 46 and pushing the pushing portion 22.

An inner thread 47 is formed on the inside of the worm wheel 46, and an operation rod thread 49 that engages with the inner thread 47 is formed on the outside of the operation rod 48.

A guide portion 50 that prevents rotation of the operation rod 48 is formed on the operation rod 48. The guide portion 50 is protrudingly formed to contact the actuator housing 41 or the handle housing 30 to prevent rotation of the operation rod 48 and guide the movement of the operation rod 48.

The actuator 40 may further include a position sensor 52 for detecting movement of the operation rod 48. The position sensor 52, shown in FIG. 3, may be a contact type switch, or as a non-contact type detecting sensor, and may be various types of sensors that detect the movement of the operation rod 48.

When the actuator 40 is operated, the outside door handle 20 is protruded, allowing the vehicle driver or occupant to operate the outside door handle 20.

In general, the actuator applied to the retractable outside door handle assembly is a linear actuator that transmits force in a straight line.

In general linear actuators, three or more stages of reduction gears are applied due to the structure characteristic, and the rotation speed of intermediate gears is fast, so vibration and noise are often generated during operation. In addition, it is difficult to change the operation power/operation speed at the time of initial design because it affects other gear combinations when adjusting the operation power and operation speed according to the gear combination method.

Also, due to excessive motor and intermediate gear rotation speed, there is a high possibility of vibration and noise during operation. In addition, multi-stage gear (e.g., three stages or more) is applied, making it difficult to optimize power and speed.

However, the actuator 40 that can be applied to the retractable outside door handle assembly according to various exemplary embodiments of the present invention has a simple structure, including the worm 44, the worm wheel 46 and the operation rod 48 engaged inside the worm wheel 46, and due to the simple structure, it is possible to optimize power and speed.

Also, since the rotation speed of the worm wheel 46 is not excessive, the possibility of vibration and noise during operation can be reduced.

Referring to FIG. 1 to FIG. 4, the retractable outside door handle assembly according to various exemplary embodiments of the present invention may further include an extension rod 56 provided between the operation rod 48 and the pushing portion 22. The extension rod 56 can adjust the distance between the pushing portion 22 and the operation rod 48, so the install position of the actuator 40 is not limited.

A predetermined gap G may be formed between the pushing portion 22 and the extension rod 56. In the event of a malfunction of the actuator 40, the operation rod 48 may not be in its original position and may stop. However, even if the actuator 40 malfunctions and the operation rod 48 stops in the middle, the outside door handle 20 can be in the original position due to the gap G.

The retractable outside door handle assembly according to various exemplary embodiments of the present invention may further include a handle leg 26 formed on the outside door handle 20 to enable contact with the door latch lever 60 when protruding by the operation of the actuator 40.

Figure 5:
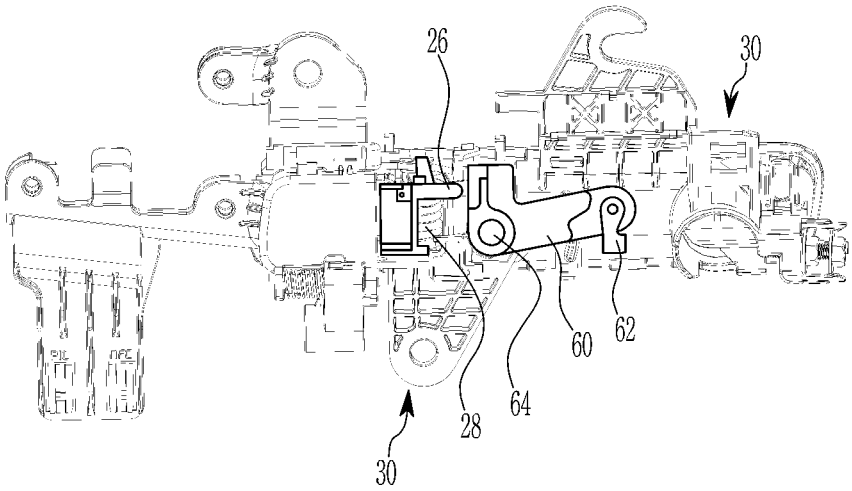
FIG. 5 is a rear view of a retractable outside door handle assembly according to various exemplary embodiments of the present invention.

FIG. 5 is a rear view of a retractable outside door handle assembly according to various exemplary embodiments of the present invention.

Referring to FIG. 5, the retractable outside door handle assembly according to various exemplary embodiments of the present invention may further include a handle spring 28 that provides a reaction torque to the outside door handle 20. After the driver or occupant manipulates the outside door handle 20, the outside door handle 20 can be repositioned into the handle housing 30 by the reaction torque of the handle spring 28.

Figure 6:
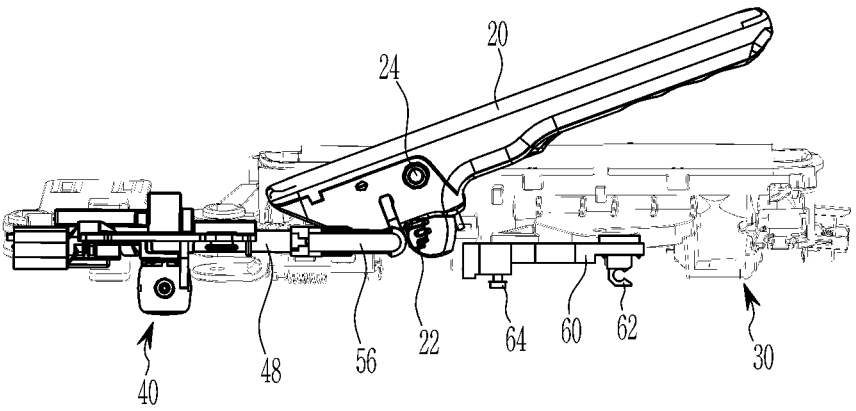
FIG. 6 is a front view of a retractable outside door handle assembly according to various exemplary embodiments of the present invention in operation of an actuator.
Figure 7:
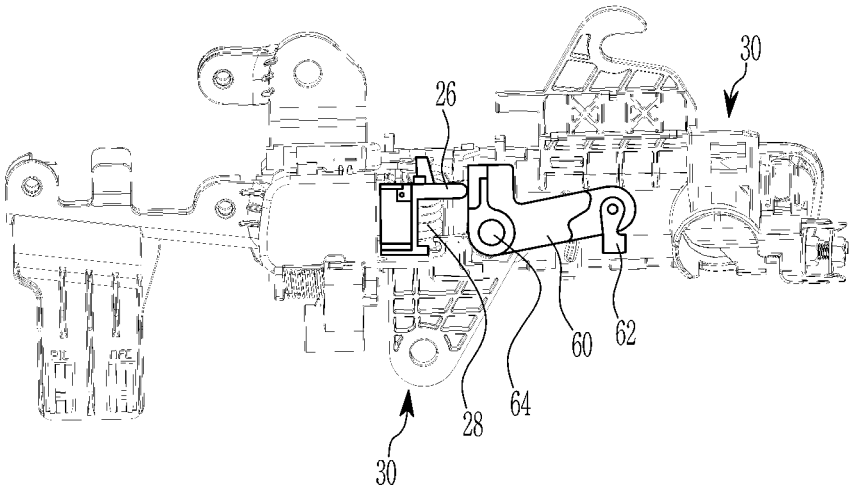
FIG. 7 is a rear view of a retractable outside door handle assembly according to various exemplary embodiments of the present invention in operation of an actuator.

FIG. 6 is a front view of a retractable outside door handle assembly according to various exemplary embodiments of the present invention in operation of an actuator, and FIG. 7 is a rear view of a retractable outside door handle assembly according to various exemplary embodiments of the present invention in operation of an actuator.

Referring to FIG. 1 to FIG. 6, when the driver or occupant holding the vehicle's smart key approaches the vehicle, or when the vehicle's controller initiates the door opening operation by operation of a wireless communication or contact switch, the controller operates the actuator 40. Then, the operation rod 48 or the extension rod 56 pushes the pushing portion 22.

Then, the outside door handle 20 rotates around the handle rotation pin 24, and the handle leg 26 contacts the door latch lever 60. At this time, the door latch lever 60 does not rotate, and in this state, the driver or occupant can grip the outside door handle 20. This state may be defined as the door open standby state.

Figure 8:
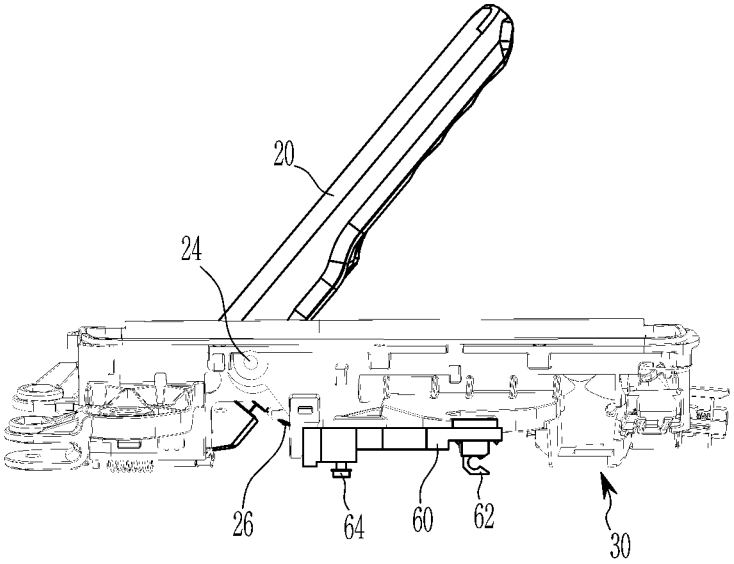
FIG. 8 is a front view of a retractable outside door handle assembly according to various exemplary embodiments of the present invention in operation of an outside door handle.
Figure 9:
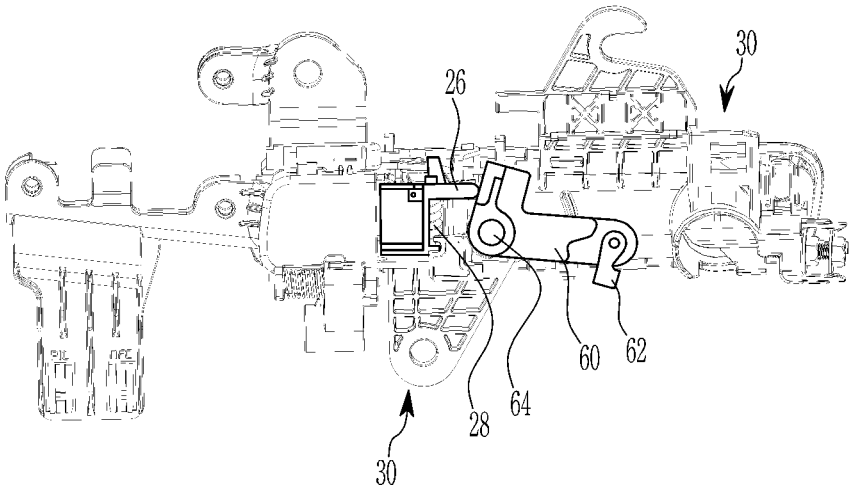
FIG. 9 is a rear view of a retractable outside door handle assembly according to various exemplary embodiments of the present invention in operation of an outside door handle.

FIG. 8 is a front view of a retractable outside door handle assembly according to various exemplary embodiments of the present invention in operation of an outside door handle, and FIG. 9 is a rear view of a retractable outside door handle assembly according to various exemplary embodiments of the present invention in operation of an outside door handle.

Referring to FIG. 8 and FIG. 9, when the driver or occupant pulls the outside door handle 20 in the door open standby state, the outside door handle 20 rotates around the handle rotation pin 24, and the handle leg 26 pushes the door latch lever 60. Then, the door latch lever 60 rotates around the door latch lever pin 64, and the connection between the door and the door latch is released through a cable or rod not shown connected to the lever hook 62.

Figure 10:
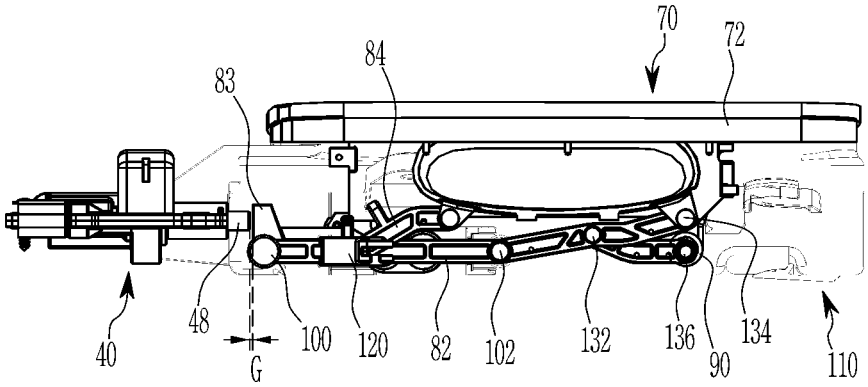
FIG. 10 is a front view of a retractable outside door handle assembly according to various exemplary embodiments of the present invention.
Figure 11:
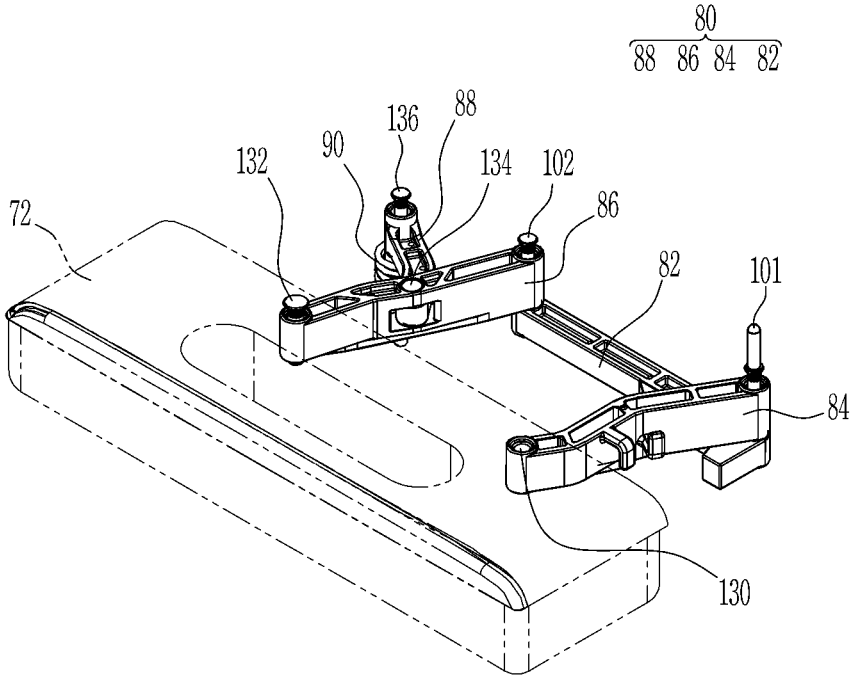
FIG. 11 is a perspective view of a handle unit that can be applied to a retractable outside door handle assembly according to various exemplary embodiments of the present invention.

FIG. 10 is a front view of a retractable outside door handle assembly according to various exemplary embodiments of the present invention, and FIG. 11 is a perspective view of a handle unit that can be applied to a retractable outside door handle assembly according to various exemplary embodiments of the present invention.

In describing the retractable outside door handle assembly according to various exemplary embodiments of the present invention shown in FIG. 10 and FIG. 11, the same/similar reference numbers are used for the same/similar configuration as the retractable outside door handle assembly according to various exemplary embodiments of the present invention described above, and repeated descriptions are omitted.

Referring to FIG. 10 and FIG. 11, the retractable outside door handle assembly according to various exemplary embodiments of the present invention includes a pushing portion 83, and a handle unit 70 including an outside door handle 72 mounted protrude to an outside of the handle housing 110, the actuator 40, and a door latch lever 120 that is rotatably mounted on the handle housing 110 and rotates during the operation of the outside door handle 72 protruded by the operation of the actuator 40.

Since the configuration and the operation of the actuator 40 is described referring to FIG. 3 and FIG. 4, repeated description will be omitted.

A predetermined gap G may be formed between the pushing portion 83 and the actuator 40. In the event of a malfunction of the actuator 40, the operation rod 48 may not be in its original position and may stop. However, even if the actuator 40 malfunctions and the operation rod 48 stops in the middle, the outside door handle 72 may be in the original position due to the gap G.

Figure 12:
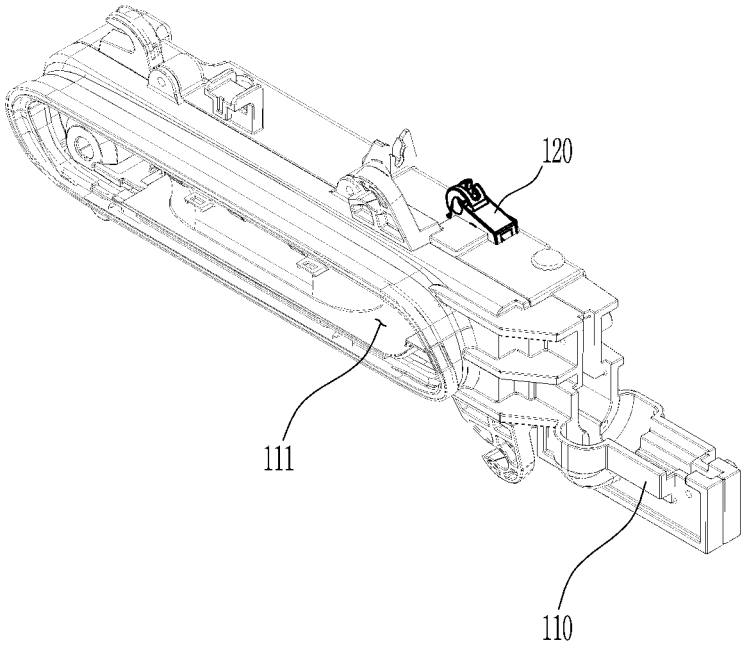
FIG. 12 is a perspective view of a handle housing that can be applied to a retractable outside door handle assembly according to various exemplary embodiments of the present invention.
Figure 13:
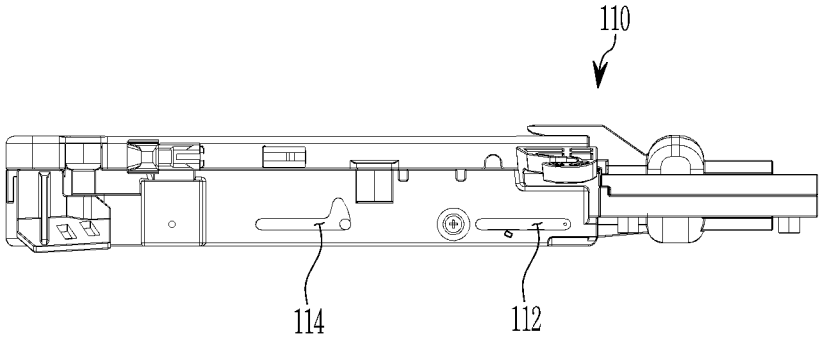
FIG. 13 is a front view of a handle housing that can be applied to a retractable outside door handle assembly according to various exemplary embodiments of the present invention.

FIG. 12 is a perspective view of a handle housing that can be applied to a retractable outside door handle assembly according to various exemplary embodiments of the present invention, and FIG. 13 is a front view of a handle housing that can be applied to a retractable outside door handle assembly according to various exemplary embodiments of the present invention.

Referring to FIG. 10 to FIG. 13, the retractable outside door handle assembly according to various exemplary embodiments of the present invention includes a link unit 80 that mounts the outside door handle 72 to the handle housing 110 so as to be protrudable.

The handle unit 80 may include a connection link 82 of which the pushing portion 83 is formed at one end thereof, and the connection link 82 mounted on the handle housing 110 to be movable along longitudinal direction thereof according to the operation of the actuator 40, a front link 84 rotatably connected to the connection link 82 and the outside door handle 72, a rear link 86 rotatably connected to the connecting link 822 and the outside door handle 72, and a support link 88 rotatably connected to the rear link 86 and the handle housing 110.

That is, the link unit 80, which can be applied to the retractable outside door handle assembly according to various exemplary embodiments of the present invention, may be composed of a four section link.

The retractable outside door handle assembly according to various exemplary embodiments of the present invention may further include a support link torque spring 90 that provides rotation torque to the support link 88.

The outside door handle 72 is protruded from the handle housing 110 and after the door open operation, the outside door handle 72 can be housed in original position in the handle housing slot 111 of the handle housing 110 by the torque of the support link torque spring 90.

The connection link 82 and the front link 84 and the connection link 82 and the rear link 86 may be connected through guide pins 101 and 102, respectively.

The front link 84 and the outside door handle 72 can be connected through a front link pin 130, and the rear link 86 and the outside door handle 72 can be connected through a rear link pin 132. In addition, the rear link 86 and the support link 88 may be connected through a connection pin 134, and the support link 88 may be connected to the handle housing 110 through a support link pin 136.

The handle housing 110 may be formed with guide slots 112 and 114, of which guide pins 101 and 102 are inserted therein, respectively, to guide the movement of the connection link 82.

FIG. 14, FIG. 15, FIG. 16 and FIG. 17 is a drawing showing the operation of the retractable outside door handle assembly according to various exemplary embodiments of the present invention.

Figure 17:
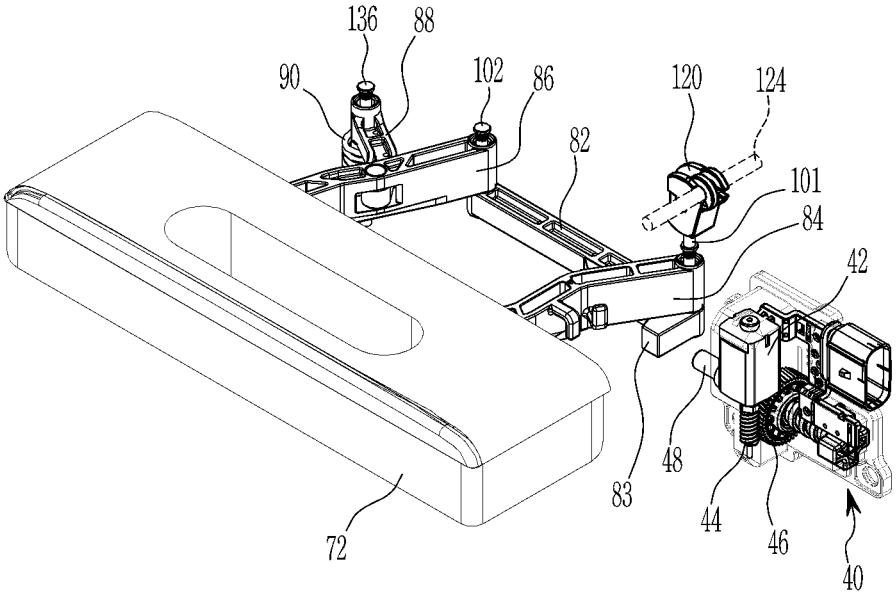

Referring to FIG. 12, the door latch lever 120 is mounted on the handle housing 110 and referring to FIG. 17, the door latch lever 120 may have a lever hole 122 into which the guide pin 101 is inserted. In the drawing, it is shown that the guide pin 101 connecting the connection link 82 and the front link 84 can be inserted into the lever hole 122, but is not limited thereto. That is, the door latch lever 120 may be mounted at a position where the guide pin 102 connecting the connection link 82 and the rear link 86 can be inserted.

Hereinafter, referring to FIG. 14, FIG. 15, FIG. 16 and FIG. 17, the operation of the retractable outside door handle assembly according to various exemplary embodiments of the present invention will be described.

Figure 14:
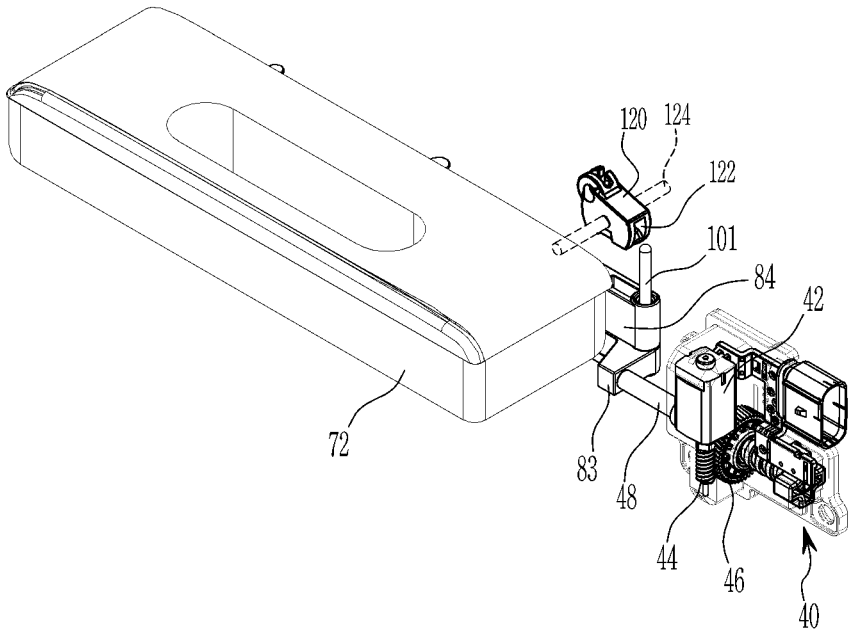
FIG. 14, FIG. 15, FIG. 16 and FIG. 17 is a drawing showing the operation of the retractable outside door handle assembly according to various exemplary embodiments of the present invention.

FIG. 14 shows a retracted state of the retractable outside door handle assembly according to various exemplary embodiments of the present invention.

Figure 15:
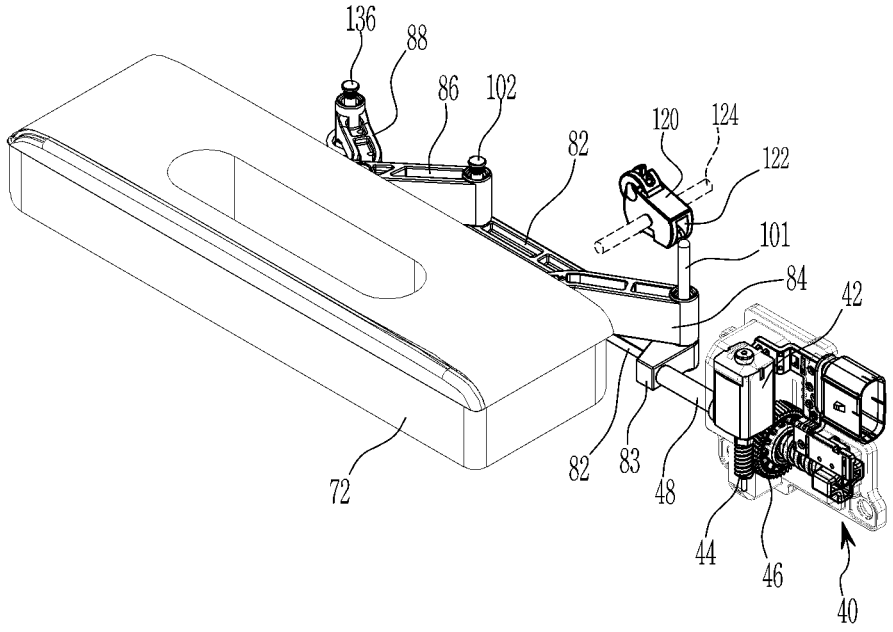

As shown in FIG. 15, when the first driver or occupant holding the vehicle's smart key approaches the vehicle, or when the controller of the vehicle initiates the door opening operation by operating a wireless communication or contact switch, the controller operates the actuator 40. Then, the operation rod 48 pushes the pushing portion 83. With the guide pins 101, and 102 inserted into the guide slots 112, and 114, the connection link 82 moves, pushing the front link 84 and the rear link 86, and the outside door handle 72 moves from the handle housing 110 to be protruded.

At this time, the door latch lever 120 does not rotate, and in this state, the driver or occupant can grip the outside door handle 72. This state may be defined as the door open standby state.

Figure 16:
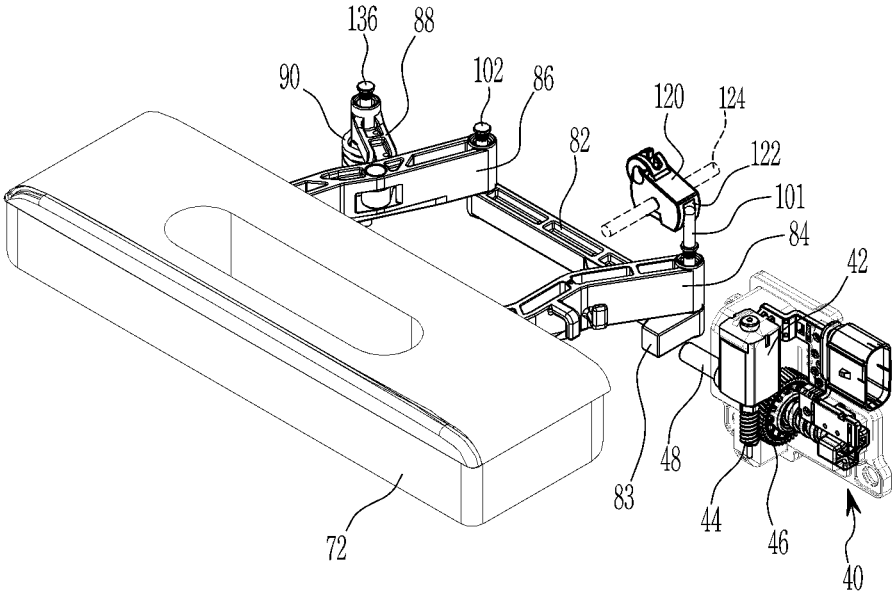

As shown in FIG. 16, when the driver or occupant grasps and pulls the outside door handle 72, the guide pin 101 is inserted into the lever hole 122. In this state, if the driver or occupant pulls the outside door handle 72, as shown in FIG. 17, the door latch lever 120 rotates around the door latch lever pin 124.

Then, according to the rotation of the door latch lever 120, a cable or rod (not shown) connected to the door latch lever 120 releases the connection between the door and the door latch. Since the structure of the connection between the door and the door latch and the cable or rod is obvious to a person skilled in the art, a detailed description will be omitted.

According to the retractable outside door handle assembly according to various exemplary embodiments of the present invention, power and operation speed tuning may be easy with a simple structure.

According to the retractable outside door handle assembly according to various exemplary embodiments of the present invention, it is possible to suppress the occurrence of vibration and noise during actuator operation. The actuator according to various exemplary embodiments of the present invention can be applied to either a swing type door handle assembly or a horizontal type door handle assembly, so that the actuator housing mold and assemble line can be shared.

Particularly, even if the handles of different swing/horizontal types have the same housing, if the extension rod is applied, the same actuator can be applied, so manufacturing cost reduction is possible.

In addition, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The controller according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method disclosed in the aforementioned various exemplary embodiments of the present invention.

The aforementioned invention can also be embodied as computer readable codes on a computer readable recording medium. The computer readable recording medium is any data storage device that can store data which can be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc. and implementation as carrier waves (e.g., transmission over the Internet).

In an exemplary embodiment of the present invention, each operation described above may be performed by a controller, and the controller may be configured by multiple controllers, or an integrated single controller.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described in order to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A retractable outside door handle assembly comprising:

a handle unit including a pushing portion and an outside door handle configured to be selectively protruded outwardly from a handle housing;

an actuator including a drive motor, a worm connected to the drive motor, a worm wheel engaging with the worm, and an operation rod that moves according to rotation of the worm wheel to selectively push the pushing portion; and a door latch lever that is rotatably mounted on the handle housing and rotates during operation of the outside door handle protruded by operation of the actuator, wherein the handle unit further includes:

a connection link of which the pushing portion is formed at one end thereof, wherein the connection link mounted on the handle housing is movable along a longitudinal direction thereof according to the operation of the actuator;

a front link rotatably connected to a first end portion of the connection link and the outside door handle;

a rear link rotatably connected to a second end portion of the connecting link and the outside door handle; and a support link rotatably connected to a portion of the rear link and the handle housing.

2. The retractable outside door handle assembly of claim 1, wherein an inner thread is formed on an inside of the worm wheel; and wherein an operation rod thread that engages with the inner thread is formed on an outside of the operation rod.

3. The retractable outside door handle assembly of claim 1, wherein the operation rod includes a guide portion that prevents rotation of the operation rod.

4. The retractable outside door handle assembly of claim 3, wherein the guide portion of the operation rod is slidably coupled to an actuator housing or the handle housing.

5. The retractable outside door handle assembly of claim 1, wherein the actuator further includes a position sensor for detecting movement of the operation rod.

6. The retractable outside door handle assembly of claim 1, further including a support link torque spring that imparts rotation torque to the support link.

7. The retractable outside door handle assembly of claim 6, wherein a first end portion of the support link is rotatably connected to the portion of the rear link, and wherein the support link torque spring is mounted to a second end portion of the support link so as to impart the rotation torque to the support link.

8. The retractable outside door handle assembly of claim 1, wherein the connection link and the front link are connected to each other through a first guide pin and the connection link and the rear link are connected through a second guide pin.

9. The retractable outside door handle assembly of claim 8, wherein the handle housing is formed with first and second guide slots into which the first guide pin and the second guide pin are inserted, respectively, to guide movement of the connection link.

10. The retractable outside door handle assembly of claim 8, wherein the pushing portion of the handle unit is pivotally coupled to an end portion of the first guide pin, and wherein an end portion of the operation rod is engaged to the pushing portion.

11. The retractable outside door handle assembly of claim 8, wherein the door latch lever has a lever hole into which one of the first and second guide pins is inserted.

12. The retractable outside door handle assembly of claim 1, wherein a predetermined gap is formed between the pushing portion and the actuator.

13. The retractable outside door handle assembly of claim 1, further including a controller connected to the actuator to control operation of the actuator.

* * * * *